US005512380A

United States Patent [19]

De Vos et al.

[11] Patent Number: 5,512,380

[45] Date of Patent: Apr. 30, 1996

[54] STEEL CORD CONSTRUCTION

[75] Inventors: Xavier De Vos, Oudenaarde; Frans Van Giel, Wevelgem, both of Belgium

[73] Assignee: N. V. Bekaert S.A., Zwevegem, Belgium

[21] Appl. No.: 269,787

[22] Filed: Jul. 1, 1994

[30] Foreign Application Priority Data

Jul. 20, 1993 [EP] European Pat. Off. ..... 93202122.3

[51] Int. Cl.[6] ..... D07B 1/06

[52] U.S. Cl. ..... 428/592; 428/608; 57/902

[58] Field of Search ..... 428/592, 606, 428/608, 626, 625; 57/402, 212, 213, 214

[56] References Cited

U.S. PATENT DOCUMENTS

| | | | |
|---|---|---|---|
| 3,685,271 | 8/1972 | Wall et al. | 57/68 |
| 3,771,304 | 11/1973 | Taketomi et al. | 57/58.57 |
| 4,781,016 | 11/1988 | Sato et al. | 57/902 |
| 4,829,760 | 5/1984 | Dambre | 57/213 |
| 4,938,016 | 7/1990 | Braunstein | 57/902 |
| 5,198,307 | 3/1993 | Bourgois | 57/212 |
| 5,303,537 | 4/1994 | Kot et al. | 57/58.36 |
| 5,375,404 | 12/1994 | Conway | 52/212 |

FOREIGN PATENT DOCUMENTS

| | | |
|---|---|---|
| 0143767 | 6/1985 | European Pat. Off. . |
| 0387803 | 9/1990 | European Pat. Off. . |

*Primary Examiner*—John Zimmerman
*Attorney, Agent, or Firm*—Foley & Lardner

[57] ABSTRACT

A steel cord (10) adapted for the reinforcement of elastomers, comprises individual steel filaments (12, 14). Some of these steel filaments (12) have a difference in torsion saturation level in comparison with other steel filaments (14). All of the individual steel filaments have a predetermined number of residual torsions and are preferably free of residual torsions. Such a steel cord is manufactured by making use of two false twisters.

10 Claims, 3 Drawing Sheets

STEEL CORD CONSTRUCTION

FIELD OF THE INVENTION

The present invention relates to a steel cord adapted for the reinforcement of elastomers such as rubber or plastic products. Examples of elastomers reinforced by means of steel cords are conveyor belts, timing belts, rubber hoses and radial tires where the carcass plies and/or the breaker plies can comprise steel cords.

BACKGROUND OF THE INVENTION

It is well known in the prior art to remove residual torsions from steel cords by means of a false twister or to set the amount of residual torsions of a steel cord to a predetermined value by means of a false twister. This is done to increase the processability of the steel cords and to give to elastomeric plies reinforced with steel cords a desired flatness. Despite the removal of residual torsions, however, some steel cords still remain difficult to be processed and the reinforced elastomeric plies do not show the required flatness. This is especially the case with compact cords, i.e. steel cords where all the filaments have been twisted in the same direction and to the same step, and with steel cords without a wrapping filament.

Supplemental mechanical processing steps of the steel cord, such as preforming or straightening, have not proved to be always sufficient to solve the above problems.

SUMMARY OF THE PRESENT INVENTION

It is an object of the present invention to solve the disadvantages of the prior art.

It is a further object of the present invention to provide a steel cord with enhanced processability properties.

According to the present invention, there is provided a steel cord adapted for the reinforcement of elastomers.

A steel cord adapted for the reinforcement of elastomers' means that the steel cord has the proper features to reinforce elastomers such as rubber tires, conveyor belts, hoses and timing belts. This means particularly, either alone or in combination, that:

the steel cord comprises steel filaments with a diameter ranging from 0.05 mm to 0.80 mm, and preferably from 0.05 mm to 0.50 mm;

the steel filaments are coated with a layer that promotes the adhesion to the elastomer; in the case of a rubber elastomer, copper alloy coatings such as brass (either low—63.5% Cu—or high copper—67.5% Cu) or a complex brass coating (Ni + brass, brass + Co . . . ) are particularly suitable;

the steel filaments have a composition which is along the following lines: a carbon content ranging from 0.70 to 0.98%, a manganese content ranging from 0.10 to 1.10%, a silicon content ranging from 0.10 to 0.90%, sulphur and phosphorous contents being limited below 0.15%, preferably below 0.010%, additional elements such as chromium (up to 0.20–0.40%), copper (up to 0.20%), cobalt (up to 0.30%) and nickel (up to 0.40%) may be added either alone or in combination;

the steel filaments have a tensile strength which is higher than 2000 MPa (Mega-Pascal=N/mm$^2$), and preferably higher than 2500 MPa; the tensile strength is dependent upon the filament diameter: the smaller the filament diameter, the higher the final tensile strength, for 0.20 mm filaments the tensile strengths can reach 3800 MPa and higher, for 0.30 mm filaments the tensile strengths can reach 3500 MPa and higher.

The steel cord of the present invention comprises individual steel filaments. Some of these steel filaments have a difference in torsion saturation level in comparison with other of these steel filaments. All of the individual steel filaments have a predetermined number of residual torsions per filament, e.g. no residual torsions per filament, or in another embodiment where the cord consists of a core of one or more core filaments and a layer of layer filaments, residual torsions of the core filament which tend to open the cord and residual torsions of the layer filaments which tend to close the cord.

The inventors have discovered that it was not sufficient that the steel cord, taken as a whole, was free of residual torsions in order to avoid processability problems, but that it was necessary to control the residual torsions of the individual steel filaments in order to further enhance the processability and to obtain reinforced elastomeric plies with a sufficient flatness.

The number of residual torsions' is herein defined as the number of revolutions made by a specific length of cord or filament (conveniently 6 meter) when one end is held in a fixed position and the other end is allowed to turn freely. It is conveniently expressed in turns per six meters.

Preferably, the individual steel filaments have been twisted individually around their longitudinal axes, which means that the steel cord has been manufactured by means of a double-twister or single-twister. Individual filaments which have been twisted around their longitudinal axes can be distinguished from filaments which have not been twisted around their longitudinal axes by the inspection of the drawing lines which are a secondary result of the necessarily imperfect final wet drawing steps: these drawing lines form a helicoid in case the filaments have been twisted around their longitudinal axes and are substantially parallel to their longitudinal axes in case the filaments have not been twisted around their longitudinal axes.

In this respect and in order to understand the present invention, a distinction must be made between applied twists to a filament (or cord), on the one hand, and residual torsions of a filament (or cord), on the other hand. If twists are applied to an individual steel filament, the drawing lines on the steel filament form a helicoid. The pitch of this helicoid is inversely proportional to the number of applied twists. The greater the number of applied twists the smaller the pitch of the helicoid. The relationship between the applied twists to a steel filament and the residual torsions of this steel filament is as follows: As long as the steel filament remains in the elastic region due to the applied twists, the number of residual torsions is equal to the number of applied twists, i.e. when one end of the steel filament is held in a fixed position, the other end will turn freely as much turns as the number of applied twists. When the number of applied twists, however, is that high that the steel filament is plastically deformed, the number of residual torsions becomes smaller than the number of applied twists. A typical saturation phenomenon can be observed: After the number of applied twists has passed a determined value, the number of residual torsions even no longer increases, i.e. the 'torsion saturation level' has been reached.

The torsion saturation level of an individual steel filament is dependent upon: the material of the steel filament, and, especially, upon the diameter of the steel filament and upon the tensile strength of the steel filament. The inventors have discovered that the reason why control of the number of residual torsions of the global steel cord was not sufficient to obtain the required processability was due to a difference in torsion saturation level of individual steel filaments and that it was necessary to take care of this difference.

Particular examples of steel cords according to the invention are wrapless compact cords, i.e. cords having filaments which all have the same twist pitch and the same twist direction and having no wrapping filament, and where some of the filaments have a filament diameter or a filament tensile strength or both which is different from the filament diameter or the filament tensile strength of the other filaments in the cord. This difference in filament diameter and/or filament tensile strength results in a difference in torsion saturation level between the individual steel filaments of the cord.

Some specific examples are:

| | | | | |
|---|---|---|---|---|
| 1 × 0.20 | I | 6 × 0.175 | pitch 10 mm | S |
| 1 × 0.22 | I | 6 × 0.20 | pitch 12 mm | S |
| 1 × 0.25 | I | 6 × 0.23 | pitch 12 mm | S |
| 1 × 0.28 | I | 6 × 0.25 | pitch 14 mm | Z |
| 1 × 0.32 | I | 6 × 0.30 | pitch 16 mm | Z |
| 1 × 0.36 | I | 6 × 0.32 | pitch 18 mm | S |
| 1 × 0.38 | I | 6 × 0.35 | pitch 20 mm | Z |
| 3 × 0.22 | I | 9 × 0.20 | pitch 12 mm | S |

BRIEF DESCRIPTION OF THE DRAWINGS

The invention will now be described into more detail with reference to the accompanying drawings wherein.

DETAILED DESCRIPTION OF A PREFERRED EMBODIMENT OF THE INVENTION

Figure 1:
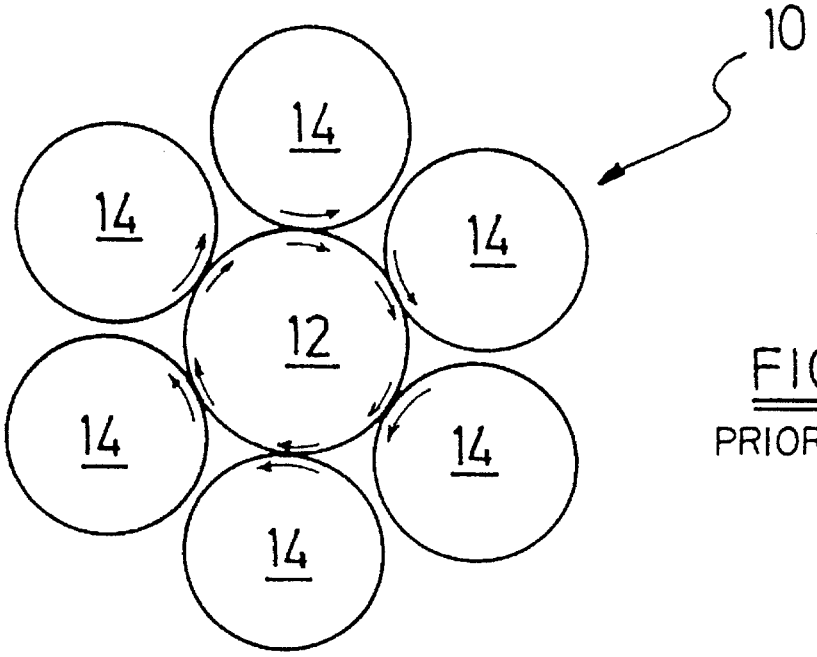
FIG.1 PRIOR ART
FIG. 1 shows a cross-section of a steel cord according to the prior art.

FIG. 1 shows the cross-section of a 1+6-cord 10 according to the prior art. The cord 10 has one core filament 12 and six layer filaments 14 surrounding and contacting the core filament 12. Suppose that the steel cord has been twisted into the Z-direction. Despite the fact that the steel cord 10, taken as a whole, is free of residual torsions, the individual steel filaments have residual torsions: the layer filaments 14 have residual torsions in the S-direction while the core filament has residual torsions in the Z-direction.

Figure 2:
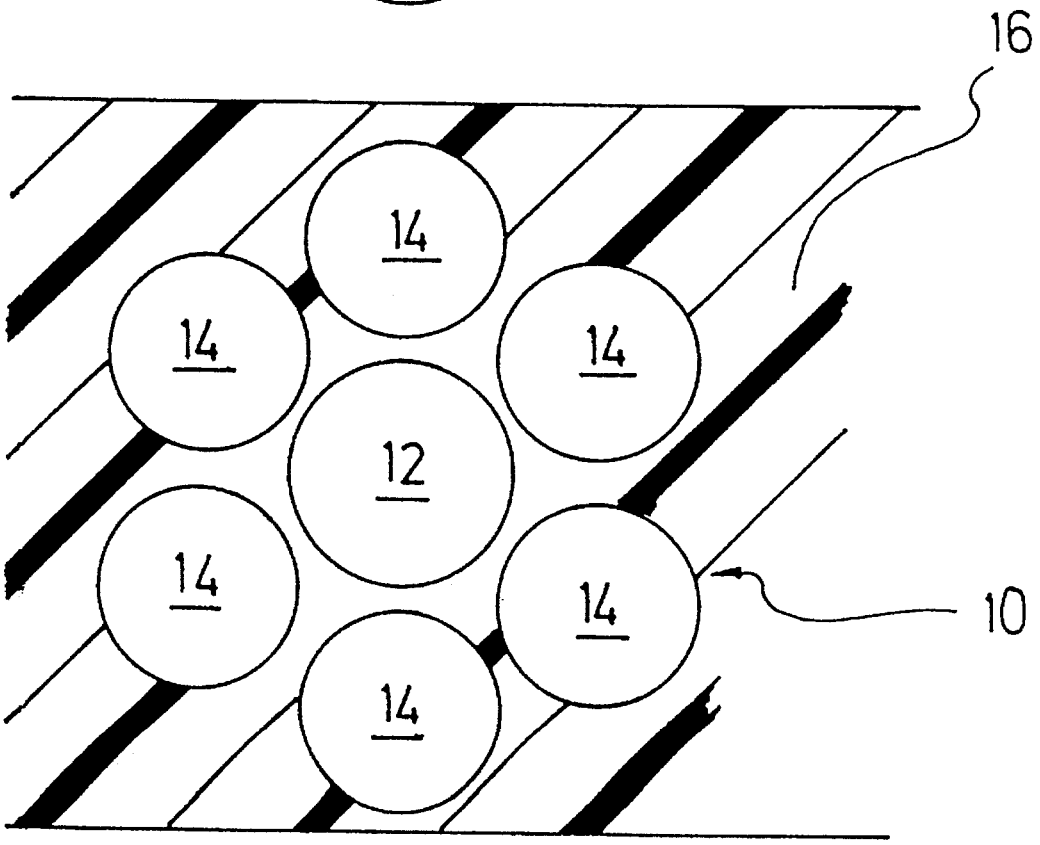
FIG.2 PRIOR ART
FIG. 2 shows an end of an elastomeric ply reinforced with a steel cord according to the prior art.

FIG. 2 shows an end of an elastomeric ply reinforced with a steel cord according to the prior art. As soon as the elastomeric ply is cut, the ends of the filaments, and particularly the end of the core filament, start to rotate in case the elastomeric material 16 has not completely filled up the interstices between the core filament 12 and the layer filaments 14. In a cross-section of the steel cord 10 the layer filaments 14 no longer contact the core filament at the place of cutting. Following disadvantages are the result. At the place of cutting the steel cord 10 has a larger diameter than designed. The interstices between the filaments 12, 14 have become much greater allowing moisture to penetrate more easily into the cord. The elastomeric ply no longer has its desired flatness over its complete surface, which results in a worse processability.

Figure 3:
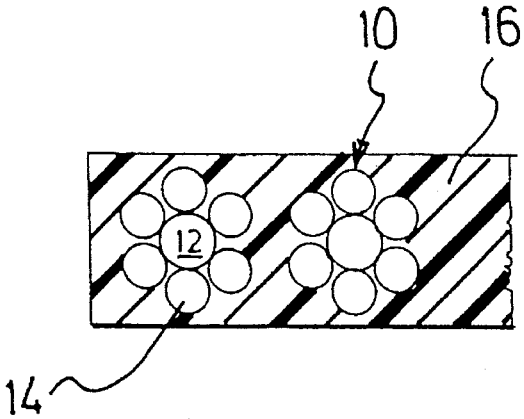
FIG. 3 shows an end of an elastomeric ply reinforced with a steel cord according to the present invention.

FIG. 3 shows an end of an elastomeric ply reinforced with steel cord 10 according to the present invention. In a steel cord 10 according to the present invention the individual steel filaments 12, 14 are free from residual torsions. As a consequence, after the elastomeric ply has been cut, the individual steel filaments 12, 14 do not rotate and contact between the core filament 12 and the layer filaments 14 is maintained. The diameter of the cord 10 does not increase, the interstices between the filaments 12, 14 do not increase and the elastomeric ply remains flat.

Figure 4:
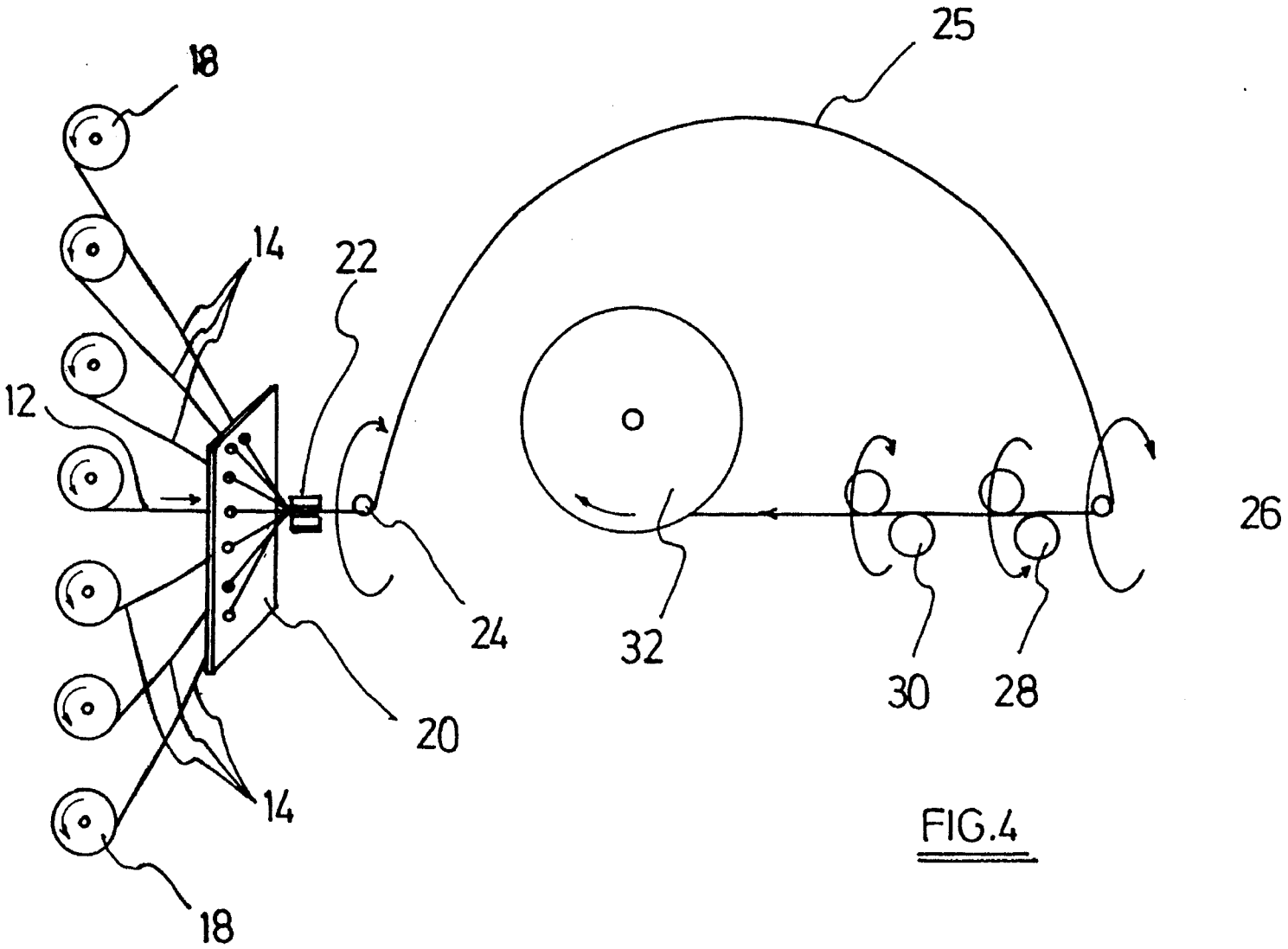
FIG. 4 illustrates schematically a method of manufacturing a steel cord according to the present invention.

FIG. 4 illustrates schematically the way of manufacturing a steel cord 10 according to the present invention. The core filament 12 and the layer filaments 14 are drawn from the supply spools 18 on the left side of the Figure and are led to a distributing disc 20 and to a cord forming die 22 where the cord 10 is at least partially formed. The thus formed cord 10 is further guided over a guiding pulley 24, a rotating flyer 25 and over a reversing pulley 26. At the level of reversing pulley 26 the cord 10 has reached its final twist pitch. The cord 10 is now further overtwisted by means of a first false twister 28, i.e. twisted to a twist pitch smaller than the final twist pitch of the cord 10 and untwisted until the final twist pitch of the cord 10. Thereafter the cord 10 is untwisted by means of a second false twister 30, i.e. untwisted to a twist pitch greater than the twist pitch of the cord 10 and twisted again to the final twist pitch of the cord 10. Finally, the cord 10 is wound on spool 32. As will be explained hereafter, correct tuning of the rotation speeds of both false twisters 28 and 30 leads to steel cords where the individual steel filaments are free from residual torsions despite the fact that some filaments have a torsion saturation level which differs from the other filaments.

Figure 5:
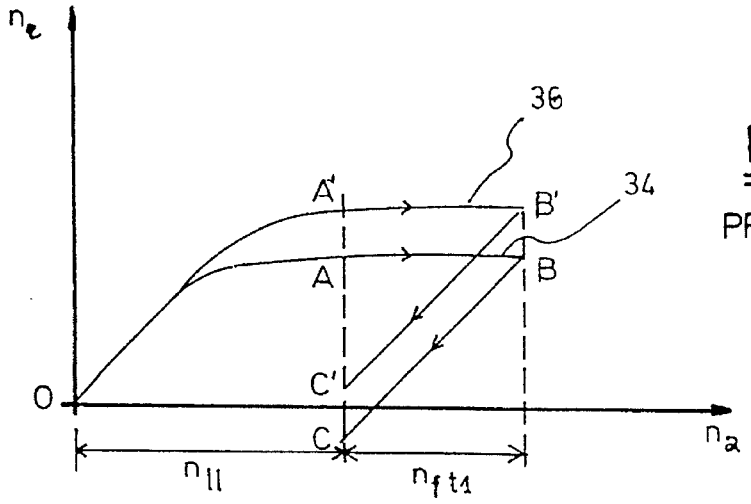
FIG.5 PRIOR ART
FIG. 5 shows torsion diagrams of steel filaments of a steel cord according to the prior art.

FIG. 5 shows torsion diagrams of steel filaments of a 1×0.20+6×0.175-cord according to the prior art manufactured in the convenient way, i.e. by making use of one single false twister in order to make the steel cord as a whole free of residual torsions.

The abscissa (horizontal axis) n, is the number of applied torsions, the ordinate (vertical axis) $n_r$ is the number of residual torsions. The torsion curve of the core filament 12 is designated by 34, the torsion curve of the layer filaments 14 is designated by 36.

While being twisted by means of a double-twister to the final twist pitch, core filament 12 follows curve OA, while layer filaments 14 follow curve OA' to a higher level of residual torsions, since the torsion saturation level of a layer filament 14 with a diameter of 0.175 mm is higher than for a core filament 12 with a diameter of 0.20 mm. The number of torsions $n_{LL}$ applied by means of the double-twister corresponds to the final twist pitch.

By means of a false twister (the only one) the cord 10 is further overtwisted to a number $n_{FT1}$ of applied torsions. The core filament 12 follows curve AB while the layer filaments follow curve A'B'. Subsequently the cord is untwisted to the same number $n_{FT1}$ of torsions in order to reach again the final twist pitch of the cord. Core filament 12 follows curve BC resulting finally in residual torsions which tend to close the cord. Layer filaments 14 follow curve B'C' resulting in residual torsions which tend to open the cord. Tuning of the revolution speed of the false twister, and, as a consequence, of the number $n_{FT1}$, is only done in order to obtain a cord which is free of residual torsions when taken as a whole.

Care is not taken of the residual torsions of the individual filaments.

Figure 6:
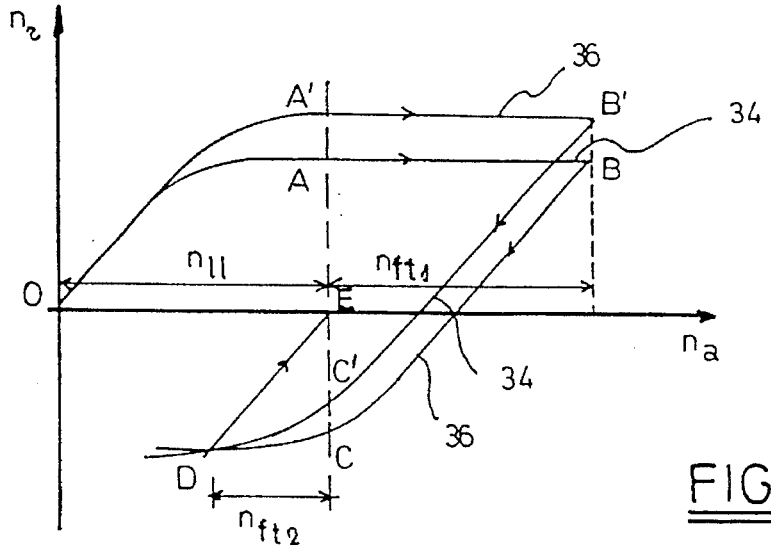
FIG. 6 shows torsion diagrams of steel filaments of a steel cord according to the present invention.

FIG. 6 shows torsion diagrams of steel filaments of a 1×0.20+6×0.175-cord according to the present invention manufactured in the way illustrated in FIG. 4, i.e. by making use of two false twisters in order to make not only the steel cord as a whole free of residual torsions but also the individual steel filaments.

The first false twister 28 has a rotation speed which is higher than the rotation speed of the only false twister of FIG. 5, which means that the number $n_{FT1}$ of torsions applied by the first false twister is higher than in the case of FIG. 5. Core filament 12 follows curve ABC and layer filaments 14 follow curves A'B'C' while being false twisted in the first false twister 28. Thereafter, a second false twister 30 untwists the cord 10 to a number $n_{FT2}$ of applied torsions and again twists the cord 10 to its predetermined final twist pitch. The revolution speed of the second false twister 30, and hence the number $n_{FT2}$ of applied torsions, are so chosen that they correspond always to the point where both torsions curves 34 and 36 cross each other. Core filament 12 follows curve CDE while layer filaments 14 follow curve C'DE, resulting in a steel cord consisting only of filaments which are free of residual torsions.

The revolutions speeds of both false twisters 28 and 30 must be so tuned that the point where the both torsion curves 34 and 36 cross each other is such that it is reached after the untwisting stage of the second false twister 30 and that the twisting of the second false twister results in zero residual torsions on both kind of filaments. Too low a revolution speed of the first false twister 28 will result in residual torsions on the filaments which will open the steel cord 10, too high a revolution speed of the first false twister will result in residual torsions on the filaments which will close the steel cord 10.

We claim:

1. A steel cord adapted for the reinforcement of elastomers, said steel cord comprising individual steel filaments, some of said individual steel filaments being twisted individually around their longitudinal axes, some of these steel filaments having a difference in torsion saturation level in comparison with other steel filaments, the cord as a whole having substantially no residual torsions and each of the individual steel filaments having substantially no residual torsions.

2. A steel cord according to claim 1 wherein the difference in torsion saturation level of the steel filaments is due to a difference in filament diameter.

3. A steel cord according to claim 1 wherein the difference in torsion saturation level of the steel filaments is due to a difference in filament tensile strength.

4. A steel cord according to claim 1 wherein said steel cord comprises a core of one or more core filaments and a layer of one or more layer filaments surrounding said core.

5. A steel cord according to claim 4 wherein the core filaments have a difference in torsion saturation level in comparison to the layer filaments.

6. A steel cord according to claim 5 wherein the torsion saturation level of the layer filaments is higher than the torsion saturation level of the core filaments.

7. A steel cord according to claim 4 wherein the core consists of three core filaments and the layer consists of nine layer filaments.

8. A steel cord according to claim 4 wherein the core consists of one core filament and the layer consists of six layer filaments.

9. A steel cord according to claim 1 wherein all the individual steel filaments have been twisted in the same direction and to the same twist pitch in order to form said steel cord.

10. A steel cord according to claim 1 said steel cord having no wrapping filament.

* * * * *